US010415928B2

(12) United States Patent
Jwszenski

(10) Patent No.: US 10,415,928 B2
(45) Date of Patent: Sep. 17, 2019

(54) HOLSTER SYSTEM

(71) Applicant: Gabor Jwszenski, Hillsboro, OR (US)

(72) Inventor: Gabor Jwszenski, Hillsboro, OR (US)

( * ) Notice: Subject to any disclaimer, the term of this patent is extended or adjusted under 35 U.S.C. 154(b) by 3 days.

(21) Appl. No.: 15/873,144

(22) Filed: Jan. 17, 2018

(65) Prior Publication Data

US 2019/0219360 A1 Jul. 18, 2019

(51) Int. Cl.
*F41C 33/04* (2006.01)
*F41C 33/02* (2006.01)

(52) U.S. Cl.
CPC ..... *F41C 33/046* (2013.01); *F41C 33/0218* (2013.01); *F41C 33/0272* (2013.01); *F41C 33/048* (2013.01)

(58) Field of Classification Search
CPC .... F41C 33/046; F41C 33/02; F41C 33/0209; F41C 33/0218; F41C 33/0227; F41C 33/041; F41C 33/043; F41C 33/045; F41C 33/0236; F41C 33/0245; F41C 33/0254; F41C 33/0263; F41C 33/0272; F41C 33/0281; F41C 33/029; F41C 33/04; F41C 33/00; F41C 33/048; F41C 33/006; F41C 33/008
USPC ..... 224/192–193, 198, 238, 243, 911–913, 224/666–670
See application file for complete search history.

(56) References Cited

U.S. PATENT DOCUMENTS 4,258,871 A * 3/1981 McMahon ..... F41C 33/046 224/192
4,627,558 A * 12/1986 Bianchi ..... A45F 5/021 224/192
5,236,113 A * 8/1993 Wisser ..... F41C 33/0227 224/193
5,246,153 A * 9/1993 Beletsky ..... A45F 3/14 224/192
5,632,426 A * 5/1997 Beletsky ..... A45F 5/021 224/192

* cited by examiner

*Primary Examiner* — Scott T Mcnurlen

(57) ABSTRACT

A convertible holster system having a bare holster sleeve that accommodates an external left or right belt carry, a left or right internal or external waistband/boot/pocket carry, a left or right dual underarm carry with adjustable holster cant, a removable left or right thumb break, an ammo clip pocket or shoulder harness stabilizer strap.

7 Claims, 12 Drawing Sheets

FIG. 15
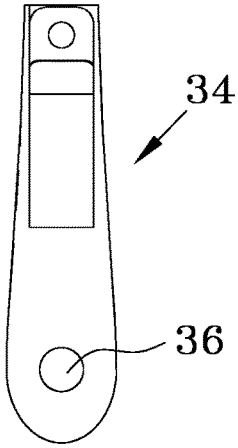
FIG. 16
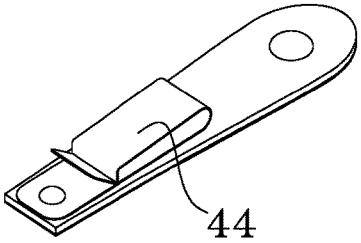
FIG. 17
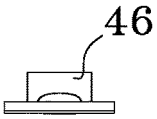
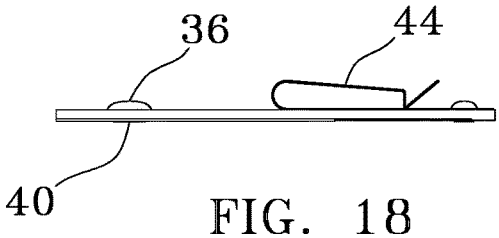
FIG. 18
FIG. 19
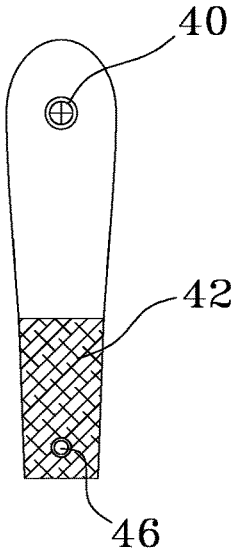

FIG. 20
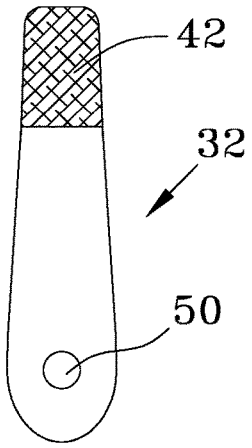
FIG. 21
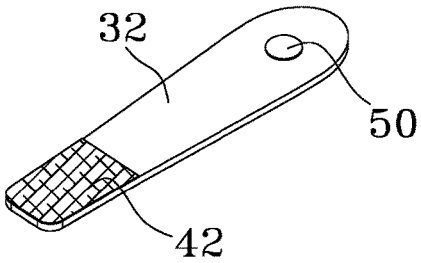
FIG. 22
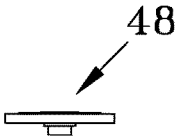
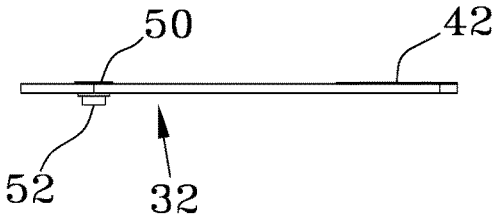
FIG. 23
FIG. 24
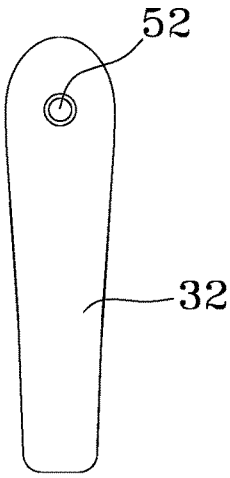

FIG. 25
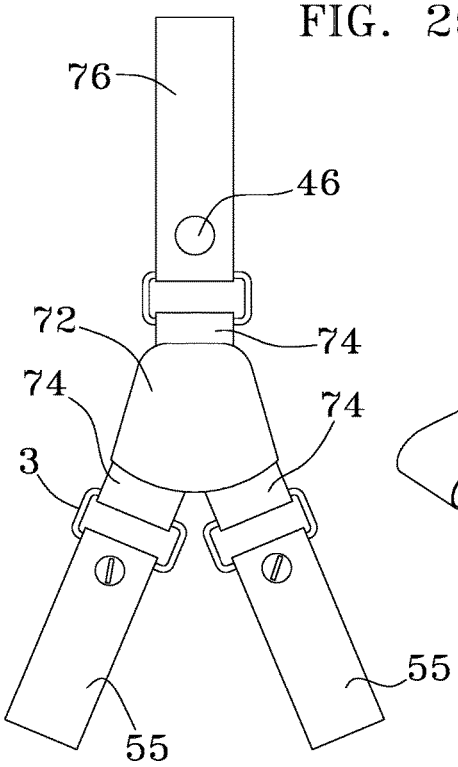
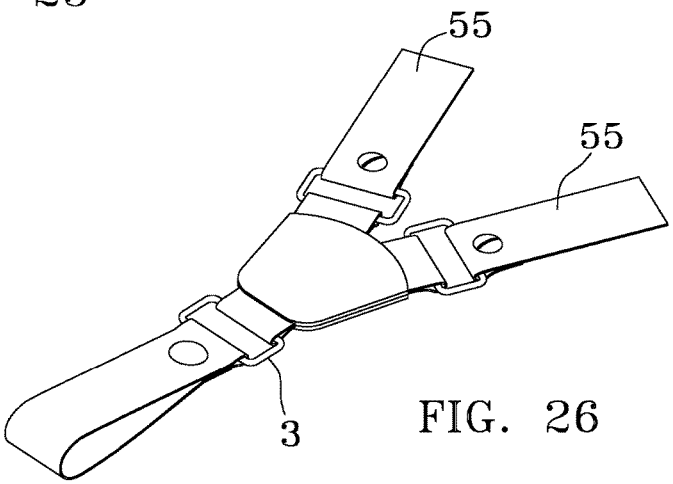
FIG. 26
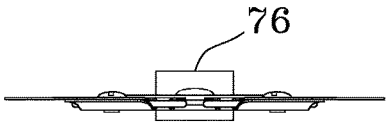
FIG. 27
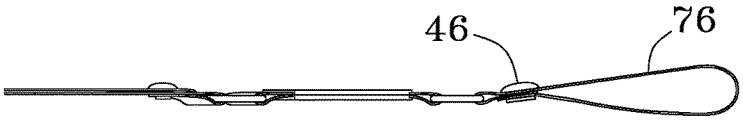
FIG. 28

FIG. 31
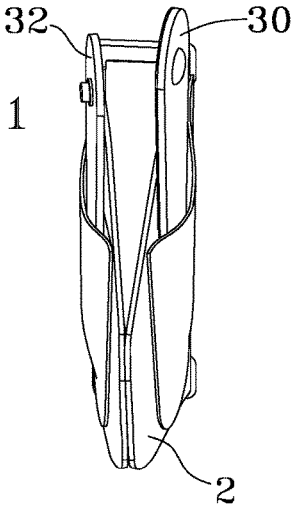
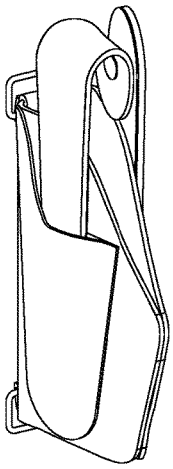
FIG. 32
FIG. 33
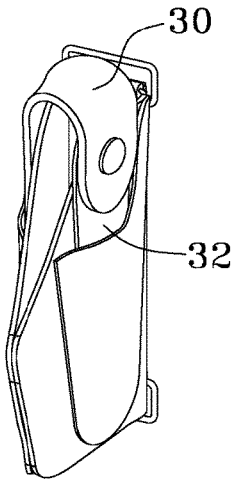
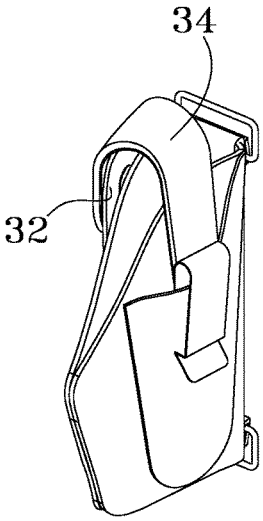
FIG. 34

HOLSTER SYSTEM

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a holster system for handguns, and more particularly to a stylized and convertible holster that can be configured in a plethora of ways, adaptable for all users and all situations.

BACKGROUND

Handguns, when not being fired, are generally in some form of holster. Some holsters are for merely for storage, some for concealment and others are for intended to allow quick, unhampered access to the handgun. Handguns, while universal in design, are used by both right and left-handed owners but holsters are made for right or left side operation and thus must be made in mirror image configurations. Most holsters are designed for a specific purpose and consequently, many gun owners have multiple holsters for each handgun they own to be used depending on what they are doing with the gun. While a handgun may be worn in clear view on an owner's belt in one state, a neighboring state may require guns to be concealed. Some owners may want an inner waistband conceal while others may want an underarm, a pocket or a boot conceal.

Henceforth, a single improved handgun holster that could satisfy all of the handgun retention needs of all handgun owners would fulfill a long felt need in the firearms industry. This new invention utilizes and combines known and new technologies in a unique and novel configuration to overcome the aforementioned problems and accomplish this.

BRIEF SUMMARY

In accordance with various embodiments, a system that allows the convertibility of a base holster into a multitude of different carry and release configurations are provided.

In one aspect, a convertible holster that accommodates an external left or right belt carry, a left or right internal or external waistband/boot/pocket carry, a left or right dual underarm carry with adjustable holster cant, a removable left or right thumb break, a ammo clip pocket or shoulder harness stabilizer strap.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 15 is a front view of the thumb break clip strap;

FIG. 16 is a front perspective view of the thumb break clip strap;

FIG. 17 is a top view of the thumb break clip strap;

FIG. 18 is a side view of the thumb break clip strap;

FIG. 19 is a back view of the thumb break clip strap;

FIG. 20 is a front view of the retention strap;

FIG. 21 is a front perspective view of the retention strap;

FIG. 22 is a top view of the retention strap;

FIG. 23 is a side view of the retention strap;

FIG. 24 is a back view of the retention strap;

FIG. 25 is a front view of the shoulder harness stabilizer strap;

FIG. 26 is a front perspective view of the shoulder harness stabilizer strap;

FIG. 27 is a bottom view of the shoulder harness stabilizer strap;

FIG. 28 is a side view of the shoulder harness stabilizer strap;

FIG. 31 is a front view of the holster sleeve with a thumb break open configuration;

FIG. 32 is a front perspective view of the holster sleeve with a thumb break closed configuration;

FIG. 33 is a is a front perspective view of the holster sleeve with reversed thumb break in a closed configuration (the mirror image of FIG. 32);

FIG. 34 is a is a front perspective view of the holster sleeve with a thumb break clip strap in a closed configuration;

DETAILED DESCRIPTION OF CERTAIN EMBODIMENTS

Figure 1:
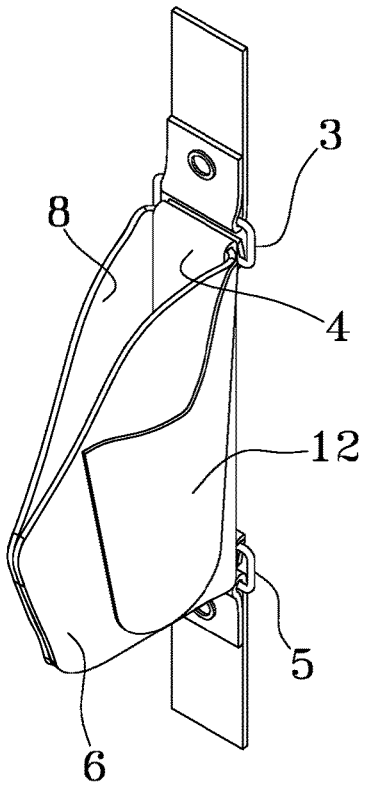
FIG. 1 is a front perspective view of the holster sleeve attached to the shoulder harness.
Figure 2:
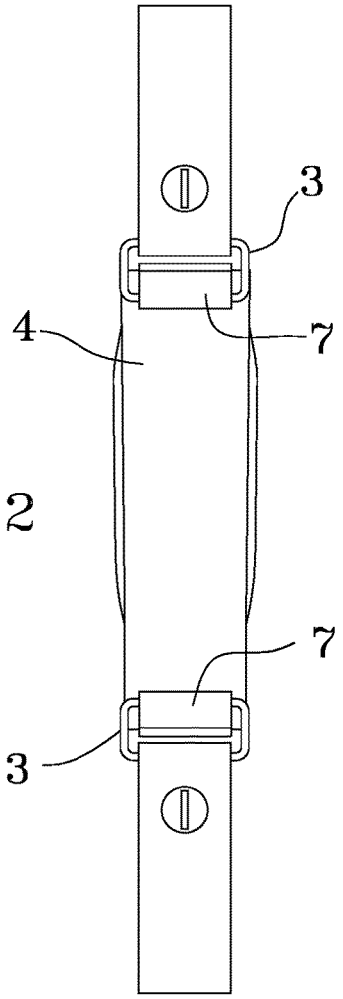
FIG. 2 is a back view of the holster sleeve attached to the shoulder harness.
Figure 3:
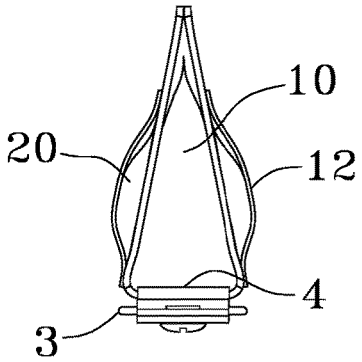
FIG. 3 is a top view of the holster sleeve.
Figure 4:
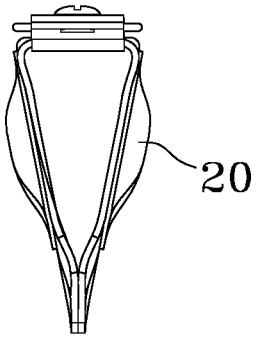
FIG. 4 is a bottom view of the holster sleeve.
Figure 5:
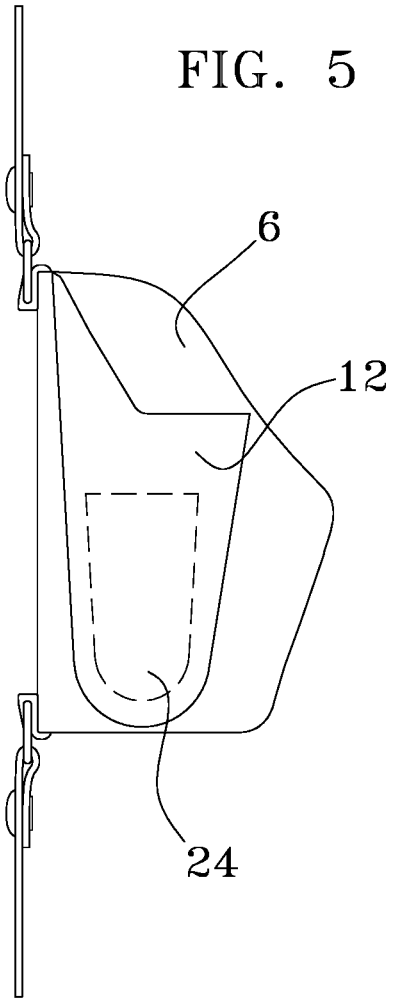
FIG. 5 is a side view of the holster sleeve showing the first half hook and loop fastener pad in phantom.
Figure 6:
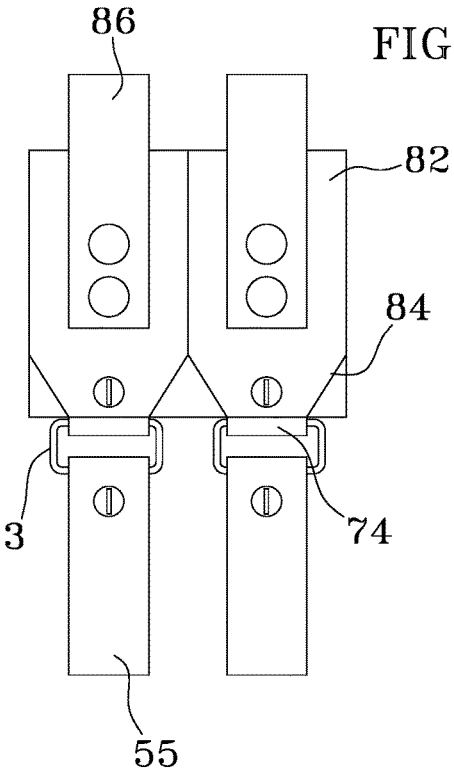
FIG. 6 is a front view of the ammo clip pocket attached to the shoulder harness.
Figure 7:
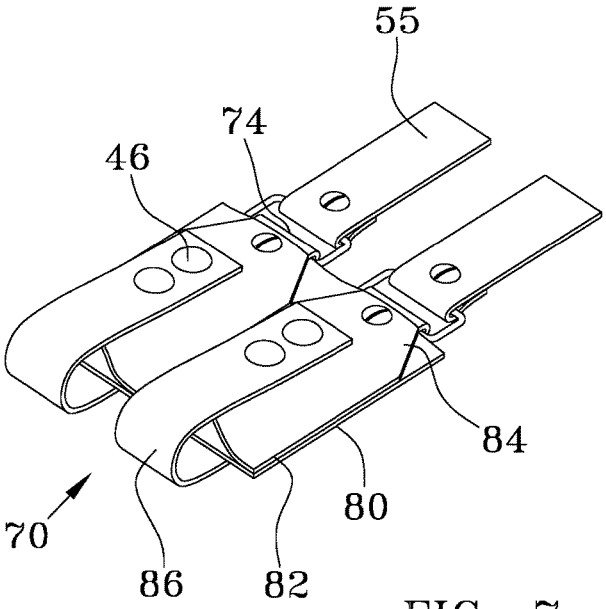
FIG. 7 is a front perspective view of the ammo clip pocket attached to the shoulder harness.
Figure 8:
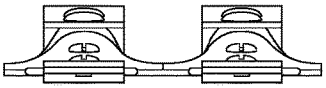
FIG. 8 is a top view of the ammo clip pocket attached to the shoulder harness.
Figure 9:
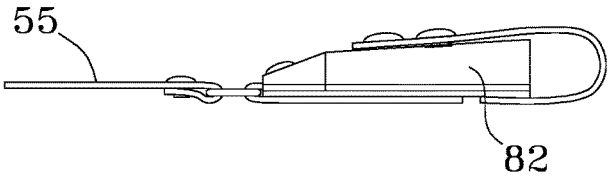
FIG. 9 is a side view of the ammo clip pocket attached to the shoulder harness.
Figure 10:
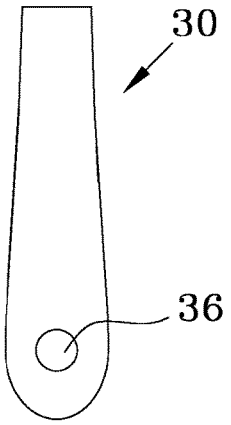
FIG. 10 is a front view of the thumb break strap.
Figure 11:
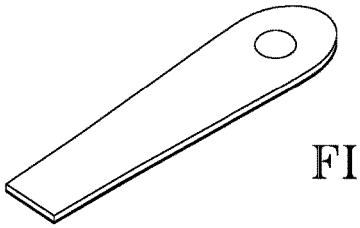
FIG. 11 is a front perspective view of the thumb break strap.
Figure 12:
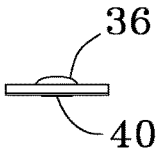
FIG. 12 is a top view of the thumb break strap.
Figure 13:
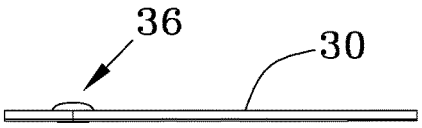
FIG. 13 is a side view of the thumb break strap.

While various aspects and features of certain embodiments have been summarized above, the following detailed description illustrates at least on exemplary embodiment in further detail to enable one skilled in the art to practice such an embodiment. The described example is provided for illustrative purposes and is not intended to limit the scope of the invention.

In the following description, for the purposes of explanation, numerous specific details are set forth in order to provide a thorough understanding of the described embodiment/s. It will be apparent to one skilled in the art, however, that other embodiments of the present invention may be practiced without some of these specific details. While various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The term "mechanical fastener" as used herein including the claims, is meant to encompass rivets, thread sewing, staples, welding, gluing, pinning, two part complimentary threaded elements intended for engagement, clips and functionally equivalent elements.

As used herein, the term "generally triangular" refers to the geometric axial cross section configuration of the holster sleeve which has three sides and three interior corners, two interior corners of which are rounded and the remaining corner formed by the joining of the vertical edges of the two sides. Since it is well known in the art that the generally triangular configuration of any holster sleeve can be made of one, two or three material panels, (rather than from a single leather panel as the preferred embodiment is) the shape of any of the the actual interior corners may or may not be rounded. Generally triangular includes all three sided axial cross section, regardless of the configuration of the three interior corners The present invention relates to a novel design for a handgun holster system ("system") that is convertible into numerous carry configurations. The basic element of the system is best seen in FIGS. 1-5 and 35. The holster sleeve 2 has a rectangular, linear rear panel 4 joined along its two longitudinal edges to two mirror image panels, a right side panel 6 and a left side panel 8, each that narrowly taper in height from their rear linear edges (those edges connected to the longitudinal edges of the rear panel 4) to their front edges which are attached to each other. These three panels form a generally triangular axial cross section that form an open sleeve 10 at both its top and bottom, for the handgun to rest in.

In the preferred embodiment these three panels are formed from a single piece of leather, (so that the side panels 6 and 8 extend from the rear panel 4 as opposed to being joined in the sense of a mechanical connection, at the longitudinal edges) although in alternate embodiments the holster sleeve 2 may be made of two or three separate fabric or polymer panels. The preferred method of connection of the right side panel 6 to the left side panel 8 is by stitching, however there are numerous other ways this could be accomplished such as by gluing, riveting, bolting, welding or functionally equivalent method. In the preferred embodiment all of the elements of the holster system are made of leather, although it is known that there are a host of other materials they can be made of including ballistic nylon, plastic and the like.

The linear rear panel 4 has upper and lower attachment rings 3 extending from its outer face. These are identical generally oval rings affixed at the top and bottom of the rear panel 4. These attachment rings are attached to the rear panel 4 by loops 7 at the top and bottom ends of the rear panel that encircles one side of the attachment rings. The loops 7 are enclosed by any of a number of methods including stitching, gluing, welding, riveting or the equivalent. This leaves the other side of the attachment rings free for attachment to the ends of the shoulder harness belts 64. In alternate embodiment these attachment rings 3 may be affixed to the rear panel 4 with molded clips or the like that are mechanically affixed to the top and bottom of the rear panel 4.

On the front face of the side panels 6 and 8 is an accessory loop 12. This loop 12 is attached at its top front corner 14, its top rear corner 16 and at its bottom edge 18. (See FIG. 36) This forms a vertical pocket 20 that has an top horizontal opening 22 below the top edge of the side panel as well as a front side vertical opening 26 and a back side vertical opening 28. (Best seen in FIGS. 3 and 36.) Affixed inside said vertical pocket is affixed a first half hook and loop fastener pad 24. In the preferred embodiment the first half hook and loop fastener pad is affixed behind the inside face of the accessory loops, on the outer face of the right and left side panels 6 and 8. (This is seen in phantom in FIG. 5.) It is to be noted that this first half hook and loop fastener pad 24 may alternately affixed to the front face of the side panels. The physical shape of the pad 24 may be rectangular, oval or round provided that it has a vertical length long enough to allow adjustability of the placement of the retention strap 32 and the thumb break straps 30 and 34 (for different sizes of pistols), and has a width that is able to be covered by the width of the planar member used for insertion and removal of the straps.

Figure 36:
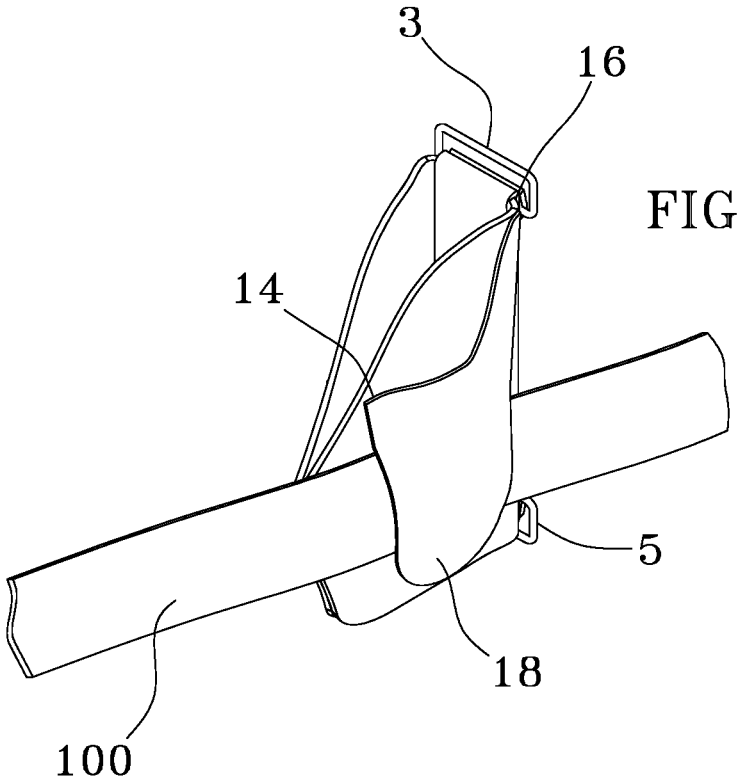
FIG. 36 is a front perspective view of the holster sleeve attached to a waist belt.

Since the accessory loop 12 has a front side vertical opening 26 and a back side vertical opening 26, a waist belt or webbing may be passed horizontally through the accessory loop 12 on either side of the holster sleeve 2 as illustrated in FIG. 36. This allows the user to wear their gun on either side of their torso. The top horizontal opening 22 allows the removable insertion of the thumb break strap 30 (FIGS. 10-14), the retention strap 32 (FIGS. 20-24) or the thumb break clip strap 34 (FIGS. 15-19) as discussed herein.

One of the more unique features of this holster system 2 is its thumb break mechanism. This is a two-piece device made of the retention strap 32 and either of the thumb break straps 30 or 34. It may be configured for the mere retention of a pistol in the holster ("gun anchor") or for the retention and quick release ("thumb break") option. These two configurations are established by the relative depths that these straps extend from the top horizontal opening 22 of the accessory loop 12.

Figure 14:
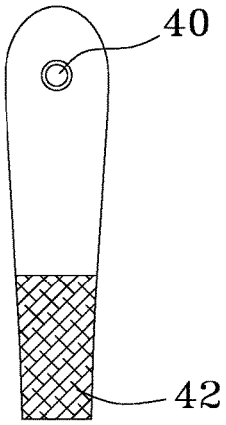
FIG. 14 is a back view of the thumb break strap.

The thumb break strap 30 (FIGS. 10-14) is a flexible linear strap having an upper end with a first half mechanical fastener affixed there through. In the preferred embodiment the first half mechanical fastener is a first half dome fastener 36. (FIGS. 12 and 13) The pressure button 38 for the first half dome fastener 36 is on the outer surface of the thumb break strap 30 (FIGS. 10 and 11) while the capture cup 40 for the first half dome fastener 36 is on the inner surface (FIG. 14). There is also a second half hook and loop fastener pad 42 affixed to the inner side, lower end of the thumb break strap 30. This is conformed for engagement with the first half hook and loop fastener pad 24 on the outer face of the right and left side panels 6 and 8 behind the accessory loops 12. (In alternate embodiments where the first half hook and loop fastener pad is affixed to the inner face of the accessory loop 12, the second half hook and loop fastener pad may be affixed to the outer face of the thumb break strap 30 and the configuration of the first half dome fastener reversed as would be known in the industry.)

The thumb break clip strap 34 (FIGS. 15-19) is identical to the thumb break strap 30 with the addition of a flexible steel U shaped clip 44 that is attached to the outer side, lower end of the thumb break strap 30. In the preferred embodiment this clip 44 is of a spring metal, having a U shaped configuration in longitudinal cross section, and is commonly referred to in the industry as a belt clip 44. It is affixed to the thumb break strap 30 by a first mechanical fastener 46, generally of a rivet or a two-part threaded style fastener such as a "Chicago screw".

Both the thumb break strap 30 and the thumb break clip strap 34 are thicker and thus more rigid than the retention strap 32. This is because in the preferred assembly configuration, these thumb break straps 30 and 34 will reside vertically along the side of the holster sleeve 2 extending above the retention strap 32 and will have to be rigid enough to allow the uncoupling from retention strap 32 by the application of a sideways force at their top. This allows the owner's thumb to slide across the curved top of the retention strap 32 and contact the top end of the thumb break strap 30 quickly and forcefully so as to horizontally uncouple the retention strap 32 and the thumb break straps 30 or 34, gaining access to the gun for withdrawal. This is explained in detail herein.

The retention strap 32 (FIGS. 20-24) is similar to the thumb break strap 30 except for that there is a second half mechanical fastener affixed there through its upper end and the thumb break strap 30 is either of a thicker material or its fabric/material is double layered to impart linear rigidity to the thumb strap 30. It again, is a flexible linear strap but having an upper end with a second half dome fastener 48 affixed there through. (FIGS. 12 and 13) The capture plate 50 for the second half dome fastener 48 is on the inner surface of the retention strap 32 (FIGS. 20 and 21) while the capture cap 52 for the second half dome fastener 48 is on the outer surface (FIGS. 22-24). There is also a second half hook and loop fastener pad 42 affixed to the inner side, lower end of the retention strap 32. This is conformed for engagement with the first half hook and loop fastener pad 24 on the outer face of the right and left side panels 6 and 8 behind the accessory loops 12. (In alternate embodiments where the first half hook and loop fastener pad is affixed to the inner face of the accessory loop 12, the second half hook and loop fastener pad may be affixed to the outer face of the retention strap 32 and the configuration of the first half dome fastener reversed as would be known in the industry.)

Figure 29:
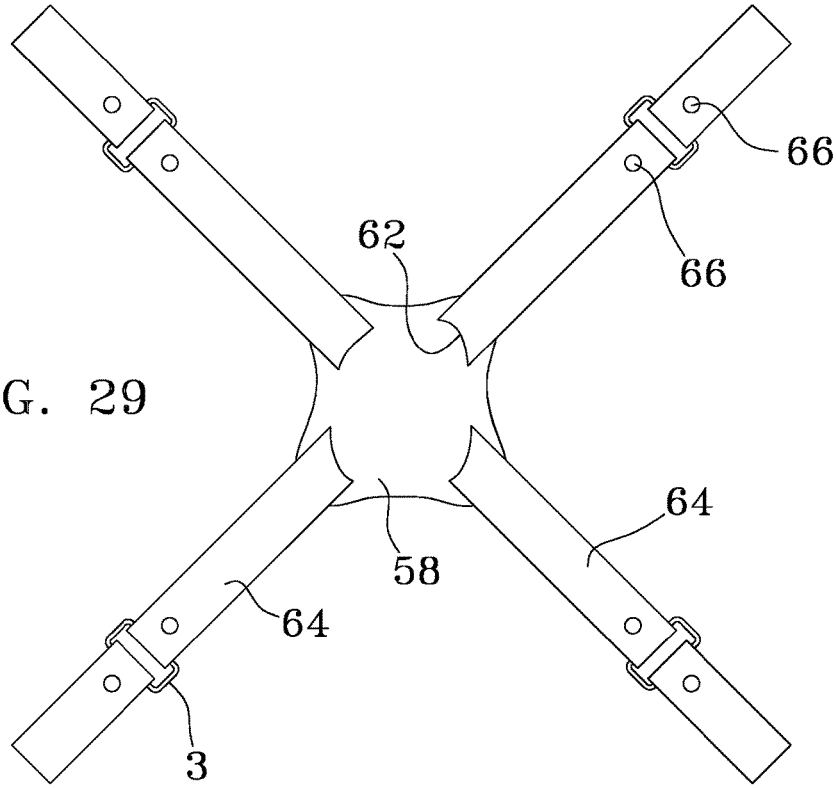
FIG. 29 is a front view of the shoulder harness.
Figure 30:
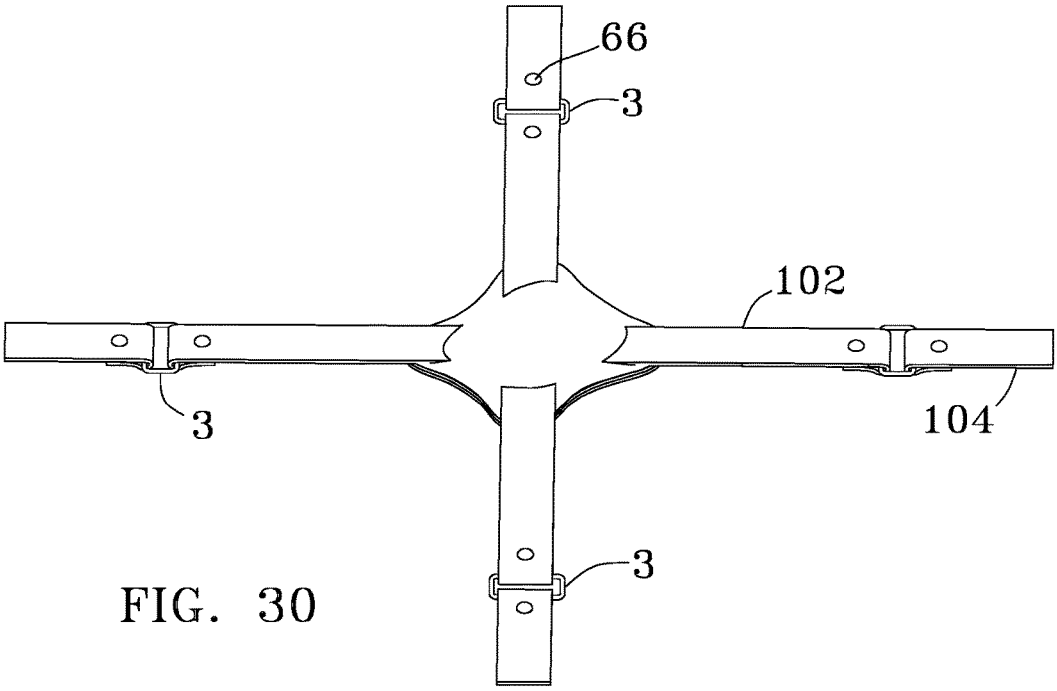
FIG. 30 is a front perspective view of the shoulder harness.

The shoulder harness 55 is a first planar leather or fabric pad 58 with two pair of opposing slits 62 cut there through to allow the perpendicular crossing of two substantially similar harness belts 64. (FIGS. 29 and 30) Each of the four slits is positioned at 90 radial degrees away from each adjacent slit with respect to the center of the pad, and are sized to allow the width of the harness belts 64 to slidingly be adjusted in the pad 58. This allows the two belts 64 to be adjusted individually within the harness 55. It is to be noted that the harness belts 64 are a two-piece segmented belt formed from an upper section belt 102 and a lower section belt 104 permanently connected to each other through an attachment ring 3 by looping the ends of the upper section belt 102 and the lower section belt 104 back onto themselves through attachment rings 3 and connecting them, preferably in a permanent fashion as would be accomplished by a rivet or mechanical stitching or the equivalent means. It is these lower section belts 104 that serve as the attachment members for the holster 2, shoulder harness stabilizer strap 60 and ammo clip pocket 70.

Each end of both of the harness belts has the same type of arrangement found on the top and bottom of the rear plate 4 for attachment to the other side of the upper and lower attachment rings 3 found on the holster sleeve 2 or the shoulder harness stabilizer strap 60 or the ammo clip pocket 70. The ends of the harness belts 64 simply fold back onto themselves and form a loop through an attachment ring 3 and are removeably affixed together, preferably by a "Chicago screw" style fastener or an equivalent mechanical fastener secured through a pair of adjacent orifices at the end of the lower section belt 104. There are several other equivalent means of fastening that could be substituted, such hook and loop fasteners, dome fasteners etc. As the attachment rings 3 are permanently affixed to the holster sleeve 2, the shoulder harness stabilizer strap 60 or the ammo clip pocket 70, the elements of the system may be removeably connected together in various configurations.

Since the individual belts are adjustable in the shoulder harness 55, when a holster sleeve 2 is affixed to one of the ends of each belt, the position of the holster sleeve 2 under the wearer's shoulder adjusted so as to change the cant or hanging angle of the pistol. This is important as different law enforcement agencies recommend different handgun hanging access angles for their officers (called "cants"). The harness belts 64 are shortened by virtue of cutting an end of the lower section belts 104 and forming two new adjacent orifices in the lower section belt 104 through which to pass the mechanical fastener 46.

Figure 37:
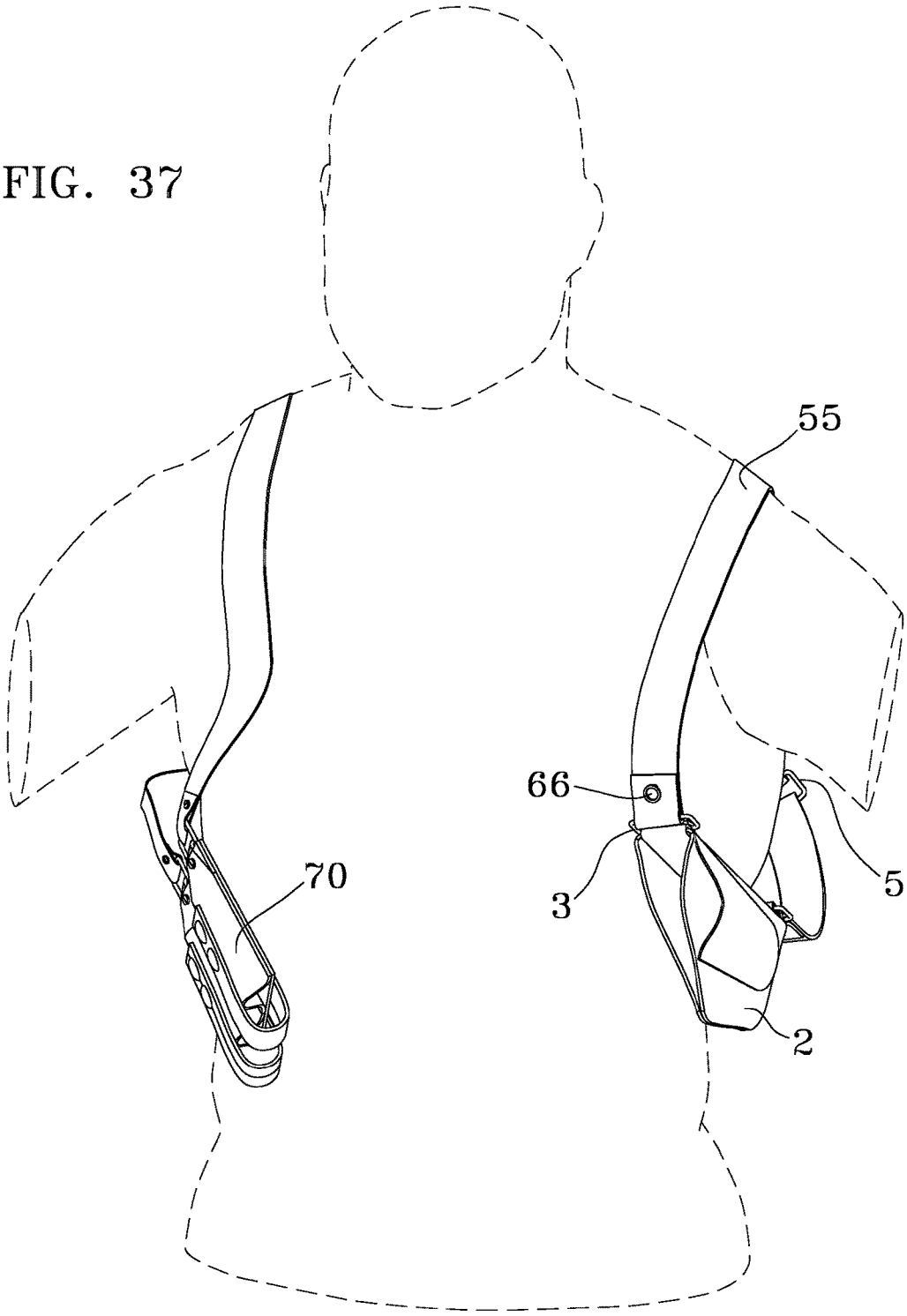
FIG. 37 is a front perspective view of a worn holster sleeve attached to one end of the shoulder harness and an ammo clip pocket attached to the other end of the shoulder harness.
Figure 38:
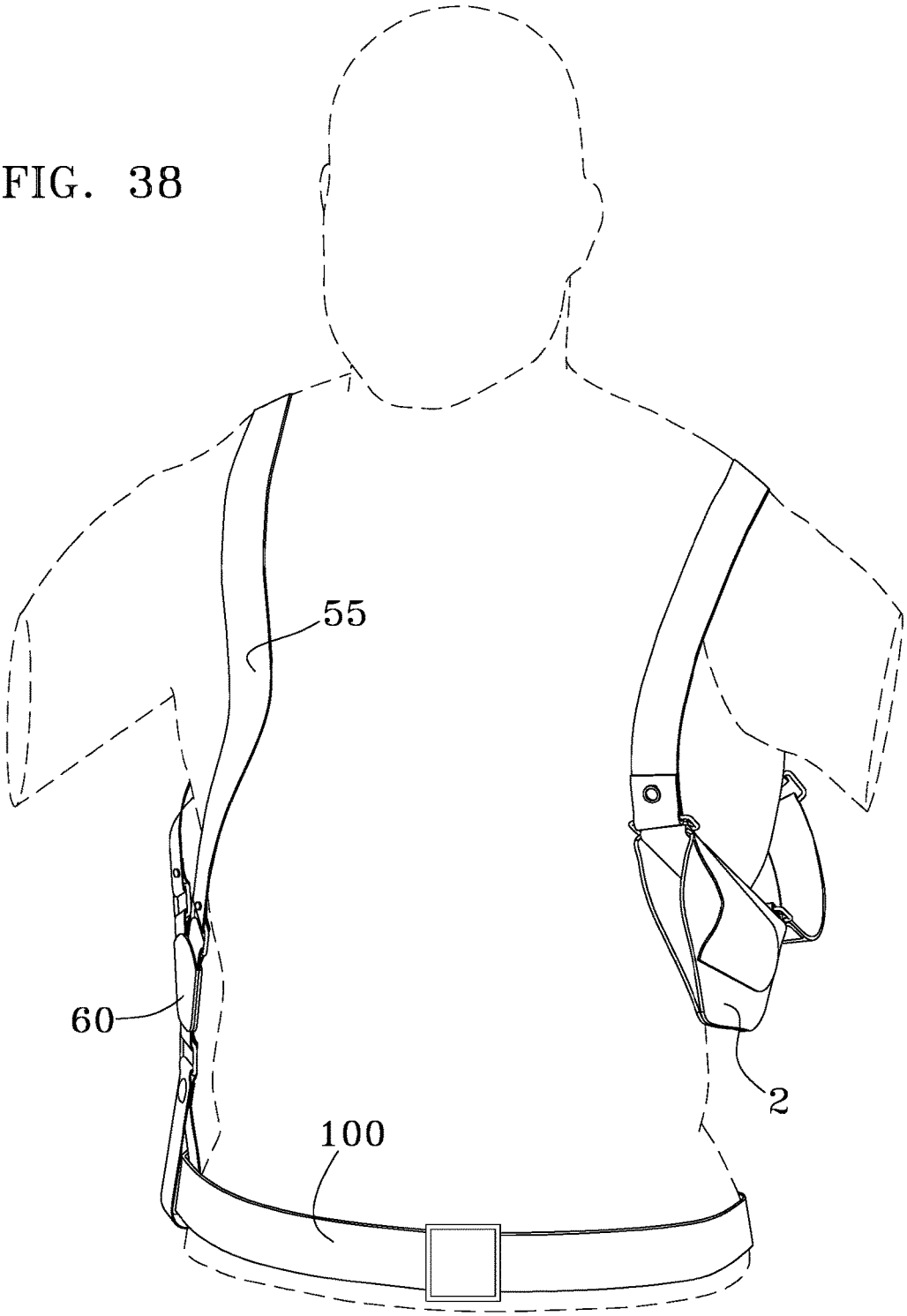
FIG. 38 is a front perspective view of a worn worn holster sleeve attached to one end of the shoulder harness and a shoulder harness stabilizer strap attached to the other end of the shoulder harness.

FIGS. 37 and 38 show the shoulder harness 55 utilized with the ammo clip pocket 70 or the shoulder harness stabilizer strap 60 attached to the wearer's waist belt 100. It is to be noted that these accessories are used to balance out the weight of the holster sleeve 2 and handgun suspended beneath one arm so as to position the pad 58 approximately centrally between the shoulders on the user's back. Since the two belts 64 are identical, the user can attach the holster sleeve to either ends of the two belts 64 respectively to hang the holster sleeve 2 under the right or left shoulder.

Looking at FIGS. 25 to 28, the shoulder harness stabilizer strap 60 can best be seen. This is a second flexible planar leather or fabric pad 72 from which extends three attachment ring loops 74. There are two top attachment ring loops and one bottom attachment ring loop. One of the attachment ring loops constrains one side of an attachment ring while the other end of the attachment ring is constrained by a waist belt loop 76. The remaining attachment ring loops 74 are for connection to the ends of the lower section belts 104 of the shoulder harness belts 64. All of the three attachment ring loops 74 have the same type of arrangement found on the top and bottom of the rear plate 4 for attachment to the other side of the upper and lower attachment rings 3 found on the holster sleeve 2 or the ends of the belts 64 of the shoulder harness 55. The mechanical fasteners 46 used here serve the function of closing the loops constraining the attachment rings. In use, the waist belt of the user's pants passes through the waist belt loop 76 while the attachment rings 3 in the top attachment ring loops are connected to the ends of the shoulder harness belts 64 whose length has been adjusted to position the shoulder harness 55 correctly. This prevents the weight of the handgun from causing the shoulder harness 55 to slid off of the shoulder above the handgun.

The ammo clip pocket 70 is a third planar leather or fabric pad 80 with a pair of open clip loops 82 formed on the front face 84. These clip loops 82 have a vertical, longitudinal axis such that the open ends are oriented at the vertical top and bottom of the pad 80. There are two ammo straps 86 extending down from the back of the pad 80 that loop from the back of the pad 80 to the front face of each clip loop 82 where they are affixed with mechanical fasteners 46. This forms two pockets in which ammo clips may reside via frictional engagement with the clip loops 82, the ammo straps 86 and the front face 84 of the pad 80. The flexible nature of the ammo straps 86 allows the user to exert upward force through them onto the end of the ammo straps 86 for release of the ammo clips. From the top end of the pad 80 are two attachment ring loops 74 similar in design to those described and used on the shoulder harness stabilizer strap 60. The ammo clip 70 also serves to stabilize the holster sleeve 2 hanging from the shoulder harness 55 but uses the weight of the ammo clips to accomplish this in lieu of the waist belt attachment point.

Figure 35:
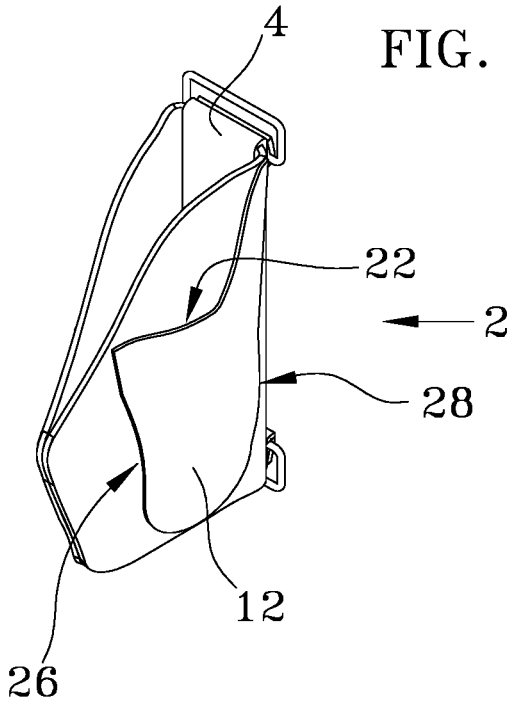
FIG. 35 is a front perspective view of the holster sleeve.

The configuration of the various embodiments of the system and uses of the holster system are best seen looking at FIG. 35 (bare holster sleeve); FIG. 36 (waist belt attachment to holster sleeve); FIGS. 31-33 (open and closed thumb breaks on a first side of the holster sleeve); FIG. 32 (closed thumb break on a second side of the holster sleeve); FIG. 34 (closed thumb break clip strap on a first side of the holster sleeve); FIG. 37 (left hung holster sleeve, shoulder harness and ammo clip pocket); and FIG. 38 (left hung holster sleeve, shoulder harness and shoulder harness stabilizer strap).

Not illustrated is the left thumb break on holster sleeve; right thumb break on holster sleeve with clip; holster sleeve, shoulder harness and second holster sleeve; right left hung holster sleeve, shoulder harness and ammo clip pocket; and right hung holster sleeve, shoulder harness and shoulder harness stabilizer strap. These are each mirror images of existing figures.

The four various configurations of thumb break mechanism, (two configurations with the thumb break strap acting as a true thumb releasable, "thumb breaks", and two configurations acting as mere "gun anchors") with and without the clip, give a total of 8 possible configurations before the combinations that can be made with the remaining system components or another holster sleeve.

Handguns, when worn for extended periods, are subject to numerous body positions of the user that may cause the occasional ejection of the handgun from the holster sleeve 2. To prevent this there is a two piece strap system made of a retention strap 32 and a thumb break strap 30 and 34 (with the clip) that join to form an openable loop around part of the handgun to constrain the handgun in the holster sleeve 2. These straps must be easily released and capable of being released by feel, not sight. Generally, these straps are released by a sideward or downward "flick" of the thumb when the hand is gripping the handgun. This "flick" is most commonly toward the body. In this light, right-handed owners right thumbs flick to the left, and left-handed owners left thumbs flick to the right when grasping a handgun. To accomplish releasing a locked thumb break mechanism, the thumb break strap 30 (or thumb break clip strap 34) which extends above the retention strap 32, is forced away from the retention strap and the top of the holster sleeve 2. Since the thumb break strap 30 has the first half dome fastener 36, when mechanically coupled to the retention strap 32, it will necessarily have to be atop and extend above and beyond the top of the retention strap 32. This will leave the top end of the thumb break strap 30 exposed and standing slightly proud of the side panel 6 or 8. Thus when the user grabs the handgun his thumb will be able to slide up the side panel 6 or 8 and easily contact the edge of the thumb break strap. From this point, a flick of the thumb will uncouple the dome fastener and release the lock strap.

To install the thumb break mechanism, requires the thumb break strap 30 or 34 and the retention strap 32 to be inserted into the side panels 6 or 8 to the appropriate depth so as to establish a "thumb break" (FIG. 32) or a "gun anchor" (FIGS. 31, 33 and 45). The depth that the thumb break strap 30 and the retention strap 32 are inserted into the side panel, establishes which function the thumb break mechanism will have. To function as a "thumb break" the retention strap 32 must extend higher vertically that the thumb break strap 30 so that the retention strap 32 will be bent to form a semicircle about the pistol so that its connector will face and matingly engage the connector on the thumb break strap 30 while the thumb break strap remains vertical. If the thumb break strap 30 is inserted so as to extend further and higher than the retention strap 32, then the thumb break strap 30 will encircle the gun and matingly engage the retention strap so as to function as an "gun anchor".

To install the thumb break mechanism, a planar member having a width less that the width of the top opening of the side panels 6 or 8, such as a popsicle stick or tongue depressor, is slid down the inside of one of the side panels 6 or 8 until the planar member covers the first half hook and loop fastener pad 24. The desired thumb break strap 30 or 34 is slid down the other side of the planar member in the side panel 6 or 8 until its bottom end with the second half hook and loop fastener is vertically in alignment with the first half hook and loop fastener on the other side of the planar member. The planar member is then slid out and pressure put on the side panel 6 or 8 to connect the two halves of the hook and loop fastener. The process is repeated on the other side panel 6 or 8 with the retention strap 32.

To remove either of the straps of the thumb break mechanism, the planar member is just forcefully slid down the side panel 6 or 8 between the inner face of the side panel 6 or 8 and the outer face of either of the thumb break mechanism straps, breaking the contact on the hook and loop fasteners halves. The strap can then be vertically raised from the side panel 6 or 8. It is to be noted that the first half hook and loop fastener 24 may be affixed to the outer face of the side panel 6 or 8 or it may be affixed to the inner face of the accessory loop 12. This will necessitate changing the side of the three thumb break mechanism straps 30, 32 or 34 that the second half hook and loop fasteners are on, so as to maintain the proper orientation of the dome fastener. It is also to be noted that although the uncouplable joining member of the thumb break straps is designated a dome fastener in the preferred embodiment, it is known that an equivalent substitution element could be magnets, hook and loop fasteners, rotatable tab and slot arrangements or a plethora of functionally equivalent other mechanical fasteners well known in the art. It is also known that the holster sleeve 2 need not have an attachment loop 12 on the side panels 6 or 8 is a belt carry is not desired. Here the thumb break straps 30, 32 and 34 would be removeably affixed to the side panels 6 or 8 as indicated herein.

Simply stated, the holster system constitutes a complete configurable set of holsters for every conceivable situation and for every conceivable gun owner. The holster can be worn clipped in a boot/inside the pants/outside the pants, looped through a waist belt, under the shoulder, with a balancing ammo clip/stabilizer strap. It can we worn in any of the above configurations on the right or left side of the owner and can also have a left or right thumb break, or no thumb break at all. If will likely be sold in a kit format that will include the following elements:

at least one holster sleeve;
at least one thumb break strap;
at least one retention strap;
at least one a thumb break clip strap;
a shoulder harness;
a shoulder harness stabilizer strap;
an ammunition clip; and
a planar member having a width less than the opening width of the top horizontal opening 22 of the side panel of said holster sleeve 2, and having a length longer than the depth of the side panel.

While certain features and aspects have been described with respect to exemplary embodiments, one skilled in the art will recognize that numerous modifications are possible.

System components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. A handgun holster kit, comprising:

at least one holster sleeve, said holster sleeve having a rear panel with two longitudinal edges, from each of said longitudinal edges extends one of a pair of mirror image side panels, each with a front edge, a top edge, a bottom edge and a back edge, said side panels joined at said front edges to form a sleeve having an open top end and an open bottom end, said sleeve having a generally triangular axial cross section;

an accessory loop affixed to each of said side panels, said accessory loops having a top front corner, a top rear corner, a bottom edge, an inner face and an outer face, said accessory loops attached at said top front corner, said top rear corner and at said bottom edge of said accessory loops to said side panels, so as to form two pockets between said accessory loops and said side panels, each pocket having a top side horizontal opening, a front side vertical opening, and a back side vertical opening;

a first half hook and loop fastener pad affixed within said pocket;

a thumb break upper strap, said thumb break upper strap being a first flexible strap having an upper strap inner face, an upper strap outer face, an upper strap upper end and an upper strap lower end, said upper strap upper end having a mechanical fastener first half affixed thereto and said upper strap lower end having an upper strap second half hook and loop fastener affixed thereto that is matingly engageable with said first half hook and loop fastener pad affixed within one of said pockets;

a retention strap, said retention strap being a second flexible strap having a retention strap inner face, a retention strap outer face, a retention strap upper end and a retention strap lower end, said retention strap upper end having a mechanical fastener second half affixed thereto and said lower end having a retention strap second half hook and loop fastener affixed thereto that is matingly engageable with said first half hook and loop fastener pad affixed within one of said pockets;

an upper attachment ring and a lower attachment ring extending therefrom a back face of said rear panel;

a thumb break upper clip strap, said thumb break upper clip strap being a third flexible strap having an upper clip strap inner face, an upper clip strap outer face, an upper clip strap upper end and an upper clip strap lower end, said upper clip strap upper end having a second mechanical fastener first half affixed thereto and said upper clip strap lower end having an upper clip strap second half hook and loop fastener affixed thereto that is matingly engageable with said first half hook and loop fastener pad affixed within one of said pockets;

and wherein said upper clip outer face has a U shaped belt attached at said upper clip strap lower end;

and wherein said second mechanical fastener first half and mechanical fastener second half are orientated such that said thumb break upper clip strap is releasably connectable to and above said retention strap;

and wherein said mechanical fastener first half and mechanical fastener second half are orientated such that said thumb break upper strap is releasably connectable to and above said retention strap.

2. The handgun holster kit of claim 1 further comprising a shoulder harness, said shoulder harness comprised of:

a flexible planar pad having a center;

a pair of harness belts, each said harness belt having two ends each of said ends folded back onto itself and joined with a releasable mechanical fastener to form a releasable loop, said releasable loop adapted to accept one of said attachment rings; and wherein said pad has a four slits cut there through, each of said slits residing 90 radial degrees apart from each adjacent slit so as to form two pair of opposing slits, said slits sized for the passage of said harness belts there through; and wherein each of said harness belts are installed into one of said pairs of opposing slits so that said harness belts cross said pad in a perpendicular fashion.

3. The handgun holster kit of claim 2 further comprising a shoulder harness stabilizer strap, said stabilizer strap is a second flexible planar pad from which extends three attachment ring loops that constrain a first side of a first, second and third attachment ring, a second side of said third attachment ring constrained by a waist belt loop; wherein said first and said second attachment loops are connectable to one of said ends of said harness belts.

4. The handgun holster kit of claim 3 further comprising an ammunition clip, said ammunition clip includes a third pad with two attachment ring loops extending from a top end of said third pad 80 constraining a first side of a fourth and fifth attachment ring, said ammunition clip having a pair of open clip loops formed on a front face of said third pad and a pair of ammo straps extending down from a back face of said third pad and looping from said back face of said pad to said pair of open clip loops where they are affixed so as to form two ammunition clip pockets in which ammunition clips may reside via frictional engagement with the clip loops, the ammo straps and the front face of said third pad.

5. The handgun holster kit of claim 4 further comprising a planar member having a width said width less than an opening width of said top side horizontal opening of said accessory loop on said side panel of said holster sleeve.

6. The handgun holster kit of claim 1 wherein said first half hook and loop fastener pad is affixed to an inner face of said accessory loop.

7. The handgun holster kit of claim 1 wherein said first half hook and loop fastener pad is affixed to an outer face of said side panel.

* * * * *